US006014106A

United States Patent [19]

Annamaa

[11] Patent Number: 6,014,106

[45] Date of Patent: Jan. 11, 2000

[54] SIMPLE ANTENNA STRUCTURE

[75] Inventor: Petteri Annamaa, Oulu, Finland

[73] Assignee: LK-Products OY, Kempele, Finland

[21] Appl. No.: 08/969,080

[22] Filed: Nov. 12, 1997

[30] Foreign Application Priority Data

Nov. 14, 1996 [FI] Finland ..... 964558

[51] Int. Cl.[7] ..... H01Q 1/24

[52] U.S. Cl. ..... 343/702; 343/906; 343/901

[58] Field of Search ..... 343/702, 895, 343/900, 901, 906, 725, 729; H01Q 1/24, 1/10

[56] References Cited

U.S. PATENT DOCUMENTS

| | | | |
|---|---|---|---|
| 4,623,895 | 11/1986 | Bowering | 343/829 |
| 5,343,213 | 8/1994 | Kottke et al. | 343/702 |
| 5,479,178 | 12/1995 | Ha | 343/702 |
| 5,594,459 | 1/1997 | Hirota | 343/901 |
| 5,621,422 | 4/1997 | Wang | 343/895 |
| 5,661,495 | 8/1997 | Saldell | 343/702 |
| 5,710,567 | 1/1998 | Funke | 343/702 |
| 5,812,097 | 9/1998 | Maldonado | 343/702 |

FOREIGN PATENT DOCUMENTS

| | | | |
|---|---|---|---|
| 380 231 A3 | 8/1990 | European Pat. Off. | H01Q 1/12 |
| 27 30 094 | 8/1996 | France . | |
| 2 280 789 | 2/1995 | United Kingdom | H01Q 1/38 |
| WO 94 10 720 | 5/1994 | WIPO . | |
| WO 94 28 593 | 12/1994 | WIPO . | |
| WO 96 24 962 | 8/1996 | WIPO . | |

OTHER PUBLICATIONS

Muller, Klaus–Peter, Lightning and Overvoltage Protection for Radio Equipment, VHR Communications, vol. No. 26, Spring, Jan 1994, pp. 19–23.

*Primary Examiner*—Hoanganh Le
*Attorney, Agent, or Firm*—Darby & Darby

[57] ABSTRACT

A radiofrequency antenna including a connector (3; 10) for mechanically and electrically connecting the antenna to the radio set and a fat monopole radiator (2; 11) forming a substantially integrated piece (1). The antenna may comprise a second antenna element (5), which is movable in relation to the integrated piece formed by the connector and the fat monopole radiator. The second antenna element is preferably a whip component, for which there is an axial aperture (7) defined in the connector and in the fat monopole radiator. The whip component may be locked in the upper position at different points (8, 8') in the aperture.

9 Claims, 5 Drawing Sheets

SIMPLE ANTENNA STRUCTURE

BACKGROUND OF THE INVENTION

1. Field of Art

The present invention relates to radiofrequency antennas.

2. Description of the Related Art

In mobile telephone applications the antenna should be small in size and durable. Since the antenna is a notably protruding part of a mobile telephone, it is highly probable that, on falling for example, it will hit the ground or another solid object. In addition, manufacture of the antenna should be as cost-effective as possible and suited to mass production. This means that the antenna should have as few components as possible, and these should withstand rough handling and be as easy as possible to manufacture.

Finnish Patent Application FI-951628 (LK-Products Oy), which corresponds to U.S. application Ser. No. 08/628,826, contains a description of a particular application of a helical antenna, which is relatively simple to manufacture and is also relatively durable. It comprises a support component and connector in one piece, a helical radiator which comprises a stem component which is soldered to the connector, and, surrounding the helix and support component, a layer of protective material by the design and coloring of which the external appearance of the antenna may be adjusted as desired. A second application of a helical antenna and the manufacture thereof are described in Finnish Patent Application FI-951670 (LK-Products Oy), which corresponds to U.S. application Ser. No. 08/630,040. The solution presented therein comprises a helical component, a connector and, situated around the helical component, an elastic protective casing, in which there may be a support component protruding inside the helix.

Replacement of the helical radiator by conductive patterns formed on a circuit board is known, for example, from Patent Publication GB-2 280 789. Such a structure is made up of a connector, a circuit board comprising conductive patterns and a protective casing.

The purpose of the helical and printed antennas described above has been to shorten the physical length of the antenna compared with a whip antenna having the same electrical length. By whip antenna is generally meant a straight conductor, which is connected by one end (its lower end) to a feed point. Frequently it is desired that a whip antenna be fitted to a mobile telephone in addition to the small helical or printed radiator, in order to increase the operating radius of the telephone. Since, however, a whip antenna is too long to be fitted rigidly to the mobile telephone, dual-purpose antennas are generally used in which the whip component may be pushed inside the mobile telephone when the telephone is in standby mode or when it is not in use. In the speech mode the whip may be pulled out, so that antenna function is improved.

In order for the antenna to also operate when the whip component is pushed inside, the telephone must comprise a second radiating element, which receives or transmits a signal regardless of the position of the whip component. In general a helical radiator is used as the second radiating element. The helix may be fitted to the top of the whip component or in such a way that the helical element is fixed to the frame of the radio telephone and the whip element is movable through the helix. In both cases, the helical radiator is in operation when the whip component is pushed inside the mobile telephone. When the whip component is pulled out, the functioning radiator is the whip or both the whip and the helix. Such an antenna structure, in which the whip and the helix function in combination when the whip component is extended, has been presented in, among others things, Finnish Patent Application FI-952742 (LK-Products Oy), which corresponds to U.S. application Ser. No. 08/654,687, which also presents as prior art certain other combination antenna solutions comprising a whip-helix combination. Finnish Patent Application FI-963097 (LK-Products Oy), which corresponds to U.S. application Ser. No. 08/907,297, presents a combination antenna in which the helical component is replaced by a printed radiator and which is chiefly intended for systems operating in the higher frequency ranges (1800, 1900 MHz), such as PCN (Personal Communication Network) or PCS (Personal Communication System).

The problem with the antennas described above, particularly in systems intended for the higher operating frequencies, is that there are growing demands on the precision of antenna manufacture. The physical length of a particular 1800 MHz antenna is approximately half that of a 900 MHz antenna which is similar in electrical characteristics. This means that the manufacturing tolerances for a helical element wound into the form of a cylindrical coil are decreasing, so that its manufacture as a mass product is not necessarily worthwhile any more. Also, the manufacturing tolerances for a circuit board element are becoming tighter and productivity is suffering.

A second problem with the antennas described above is the number of components included in the antenna, and consequently the number of work stages of antenna manufacture and the complexity of antenna assembly. For example, the helix in a helical antenna is wound to the desired form, the helix is put in place and attached to the connector, a support may possibly be inserted into the helix and a protective layer formed around the helix. The printed antenna manufacturing process is also multi-stage. The correct conductive pattern must be formed on the circuit board, the board must be cut to the correct size, the board must be put in place and attached to the connector and around all of this a protective casing must be placed. Furthermore, if a combination antenna is made, fitting the whip and for example the helix together demands its own type of precision. It must also be pointed out that, at each stage of manufacture of the product, errors may occur which impair the performance of the antenna, in which case the manufacturing yield is reduced or an unreasonable amount of time has to be spent on rectification of errors.

The aim of the present invention is to provide an antenna structure in which from the manufacturing standpoint includes only a few different components. The aim of the invention is also to present an antenna structure which during manufacture is easy to comply with the mechanical tolerances necessitated by the relatively small size. A further aim of the invention is to present an antenna structure which is mechanically durable. In addition, the aim of the invention is to present an antenna structure which is well suited to relatively large-scale series production.

SUMMARY OF THE INVENTION

The present invention is directed to an antenna structure in which the radiating element is a fat monopole rigidly attached to a connector.

The antenna structure according to the present invention includes a connector, a first antenna element, and a second antenna element, wherein the first antenna element is a fat monopole radiator and the second antenna element is movable in relation to the fat monopole radiator.

In this invention, a certain antenna type which is in itself known is applied in a new way which is in particular suited to mobile telephones and other small radio sets. The thickness of the whip antenna in a direction perpendicular to its physical length is usually so small that the whip antenna may be regarded as a unidimensional conductor. The fat monopole differs from the whip antenna precisely by its fatness. A typical fat monopole is a cylindrical component which has a predetermined length in the direction of its axis, and in a direction perpendicular to its axis has a fatness which is a fraction of that length, for example, approximately ¼ or ⅓. From the prior art, computational methods are known whereby it is possible to calculate an electrical length corresponding to certain physical dimensions of a fat monopole. It has been recognized that the thicker one makes a cylindrical conducting component, the more one is able to shorten it without its resonance frequency being changed. The feed point of the fat monopole is most commonly on its other end face or on the face which bounds the cylindrical component in question in a direction perpendicular to the axis thereof.

In the antenna according to this invention, the fat monopole and the connector with which the antenna structure is connected to the radio set form essentially an integrated piece. In a preferred embodiment of the invention the connector and the fat monopole are one and the same piece, which is manufactured from a blank of electrically conductive material, for example, by turning. Alternatively, a structure may be used in which the connector and the fat monopole are manufactured separately, but joined to one another, for example by screwing one element having a threaded spigot into the other element having a threaded aperture, wherein the assembled structure looks externally like a structure made from one piece.

As the number of components to be manufactured separately increases, however, the antenna manufacturing costs increase.

On the fat monopole it is advisable to fit an insulating protective casing, so that direct contact between the fat monopole and other objects does not alter the radiation characteristics of the antenna. Furthermore, the protective casing may have a favorable impact upon the external appearance of the radio set. The protective casing may, for example, be made from plastic by injection molding or by some other suitable procedure and it may be attached to the fat monopole, for example by a glued or fused. This invention does not place restrictions on the material, design or method of fixing of the protective casing.

The combination of a connector and a fat monopole is particularly well suited for combined antennas which comprise an extensible whip component. In the center of the axially symmetrical component, which is formed from a connector and a fat monopole, and in the direction of the axis thereof, an aperture may be formed in which the whip component fits with the possibility of backward and forward motion. At the outer end of the whip component there is a widening or other shaped part which the user can easily grasp. At the bottom of the whip component there is a widening or sleeve-shaped contact component (a lamellar sleeve) which, when the whip component is extracted, on the one hand acts as the feed point of the whip antenna and on the other hand prevents the whip component from sliding out completely through the connector and fat monopole.

The manufacture of the integrated fat monopole and connector, for example by turning, involves routine machining in which an accuracy of about one hundredth of a millimetre is easily achieved, particularly with numerically controlled machine tools. Since antennas thus far have included some sort of connector, continued machining of the same piece so that it also incorporates the fat monopole entails only very little additional work when compared with manufacture of the connector alone. At the same time, work stages which would be required for the manufacture of a helical antenna or printed radiator and attachment thereof to a connector are entirely avoided, and therefore, when compared with the prior art, the present invention significantly accelerates and facilitates the manufacture of a relatively small antenna. The structure formed by the connector and fat monopole is also mechanically durable so as to be substantially unbreakable.

BRIEF DESCRIPTION OF THE DRAWING

The invention will now be described in greater detail with reference to preferred embodiments presented by way of example, and to the attached drawings, where.

DESCRIPTION OF THE PREFERRED EMBODIMENTS

Figure 1:
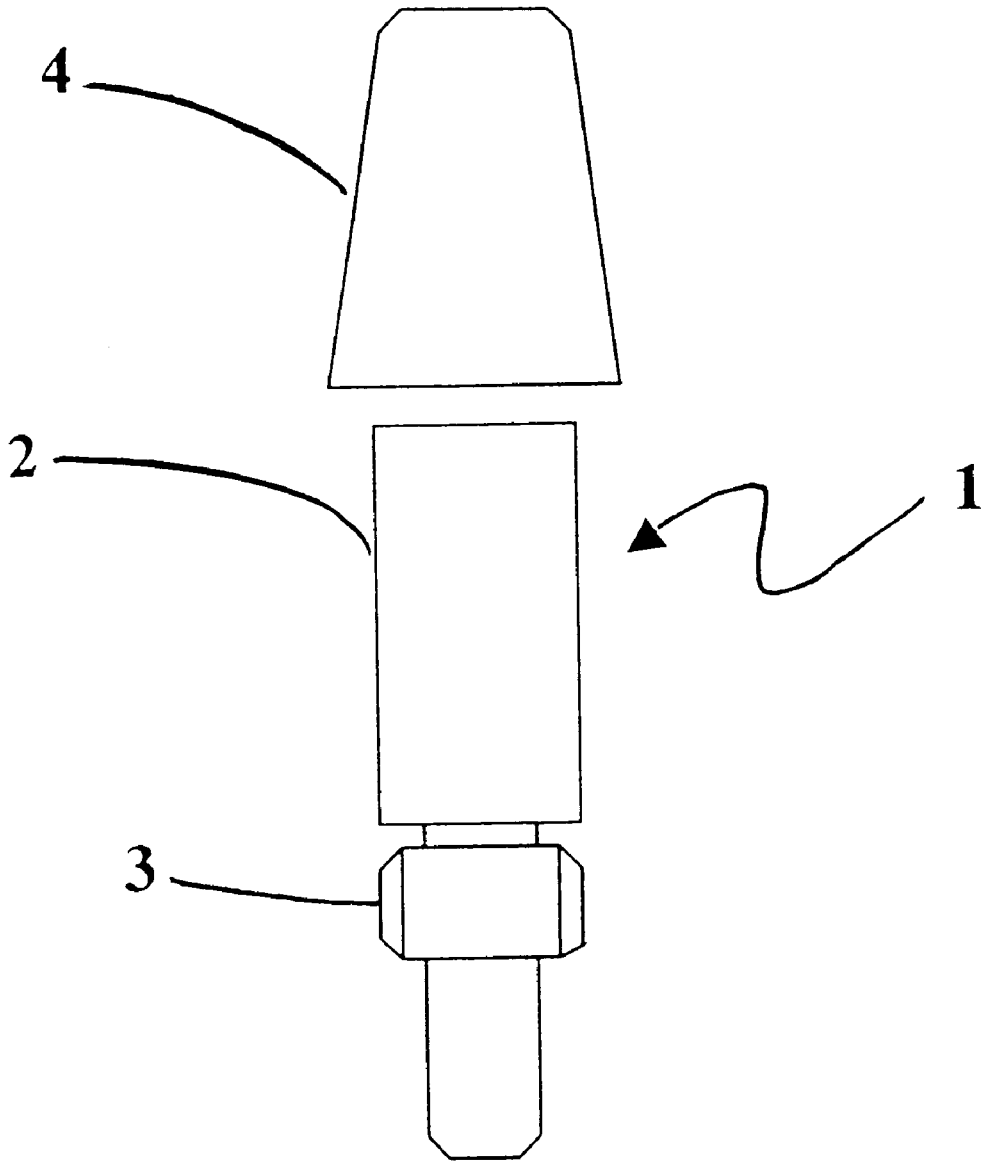
FIG. 1 is a preferred embodiment according to the present invention.

FIG. 1 shows one embodiment of the antenna according to the present invention. The antenna comprises a body 1 made from one piece, which is substantially symmetrical with respect to its axis. The antenna is shown in FIG. 1 from the side or from a direction perpendicular to the axis of symmetry. The body 1 is preferably manufactured by turning and its components include a fat monopole radiator 2 and, as a continuation thereof in the direction of the axis of symmetry, a connector 3 with which the antenna is electrically and mechanically connected to the radio set. The other part of the antenna structure which is shown in FIG. 1 is the protective sheath 4 made from an insulating material, which may for example be injection-molded plastic, and designed to slide over the fat monopole radiator in the direction of the axis of symmetry of the structure. The protective sheath is fixed in place, for example, by a glued or fused joint.

The connector 3 which forms part of the body 1 of the antenna is manufactured to suit the radio set, and therefore its structure is dependent upon the nature of the antenna attachment point in the radio set. Generally, for attachment of the antenna, a radio set has a threaded cylindrical aperture, in which case the external surface of the connector 3 must have a corresponding screw thread and the antenna is attached to the radio set by screwing the antenna in. Instead of a screw thread different types of quick-release locking mechanisms, in which a fastening profile of the connector locks into the corresponding fastening profile of the radio set by a simple movement, may be used. The fat monopole 2 at the top of the body 1 is dimensioned for the desired operating frequency by selecting a suitable diameter and length. Such dimensioning is easy to carry out and is a technique familiar to persons skilled in the art.

Figure 2A:
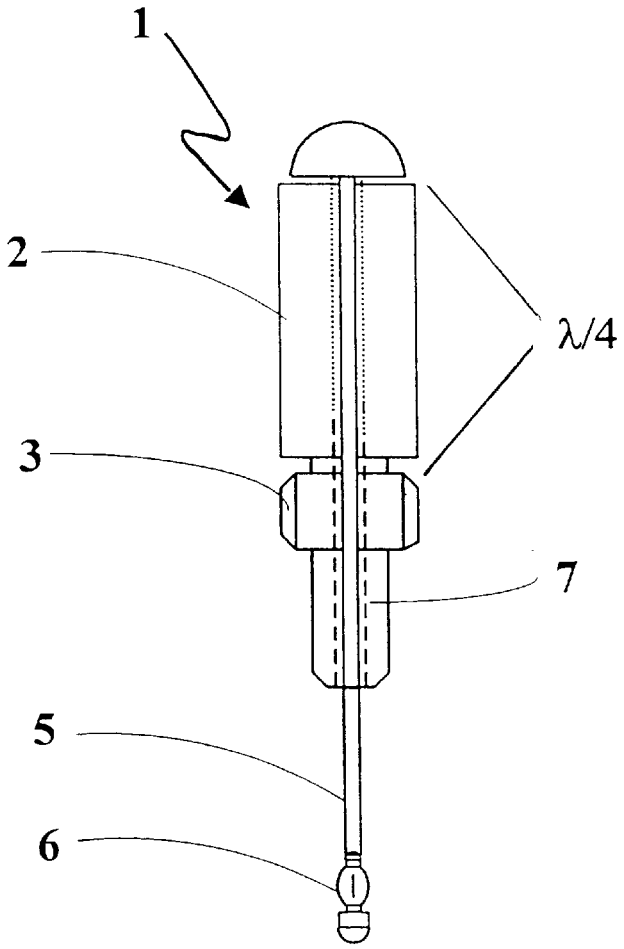
FIG. 2*a* is a preferred embodiment of a combined antenna according to the present invention with the whip component retracted.
Figure 2B:
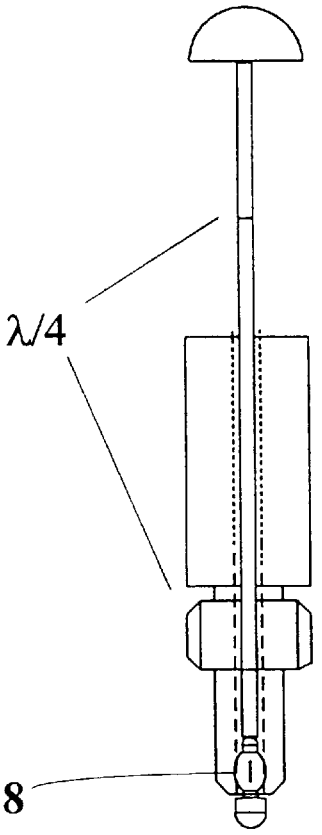
FIG. 2*b* is the combined antenna of FIG. 2*a* with the whip component pulled out.

FIGS. 2*a* and 2*b* show a particular application of a combined antenna according to the invention. In FIGS. 2*a* and 2*b*, parts which correspond functionally to parts shown in FIG. 1 are marked with the same reference numbers. In this embodiment, the antenna consists of a body 1, in which there is a connector 3 and a fat monopole 2, the electrical length of which is one quarter of the wavelength corresponding to the operating frequency of the antenna. Through the body 1, in the direction of its axis of symmetry, an aperture 7 is defined, for example by drilling. The diameter of the aperture 7 is so great that the whip component 5 of the combined antenna moves smoothly therein in the direction of its axis. To the bottom of the whip component is attached a lamellar sleeve 6, with the aid of which the whip component is electrically connected to the bottom of the connector at point 8, when the whip is extended. In the embodiment in the drawing, the whip component and the fat monopole are both electrically of dimension $\lambda/4$, where $\lambda$ signifies the wavelength at the operating frequency. The whip component and the fat monopole may together be referred to as the true radiating antenna elements of the structure, or more concisely the antenna elements, as distinct from the connector, the protective casing and other parts of the structure. A protective casing, not illustrated in FIGS. 2*a* and 2*b*, may be fitted on the monopole element. The protective casing must also have an aperture for the whip component 5. The insulating button or other shaped part on the top of the whip component offers the user a point by which the whip component may be easily grasped in order to be moved. This invention does not restrict the design of the top of the whip component. The terms top and bottom relate to the normal position of use of the whip component and do not restrict application of the invention to any particular orientation.

Figure 3A:
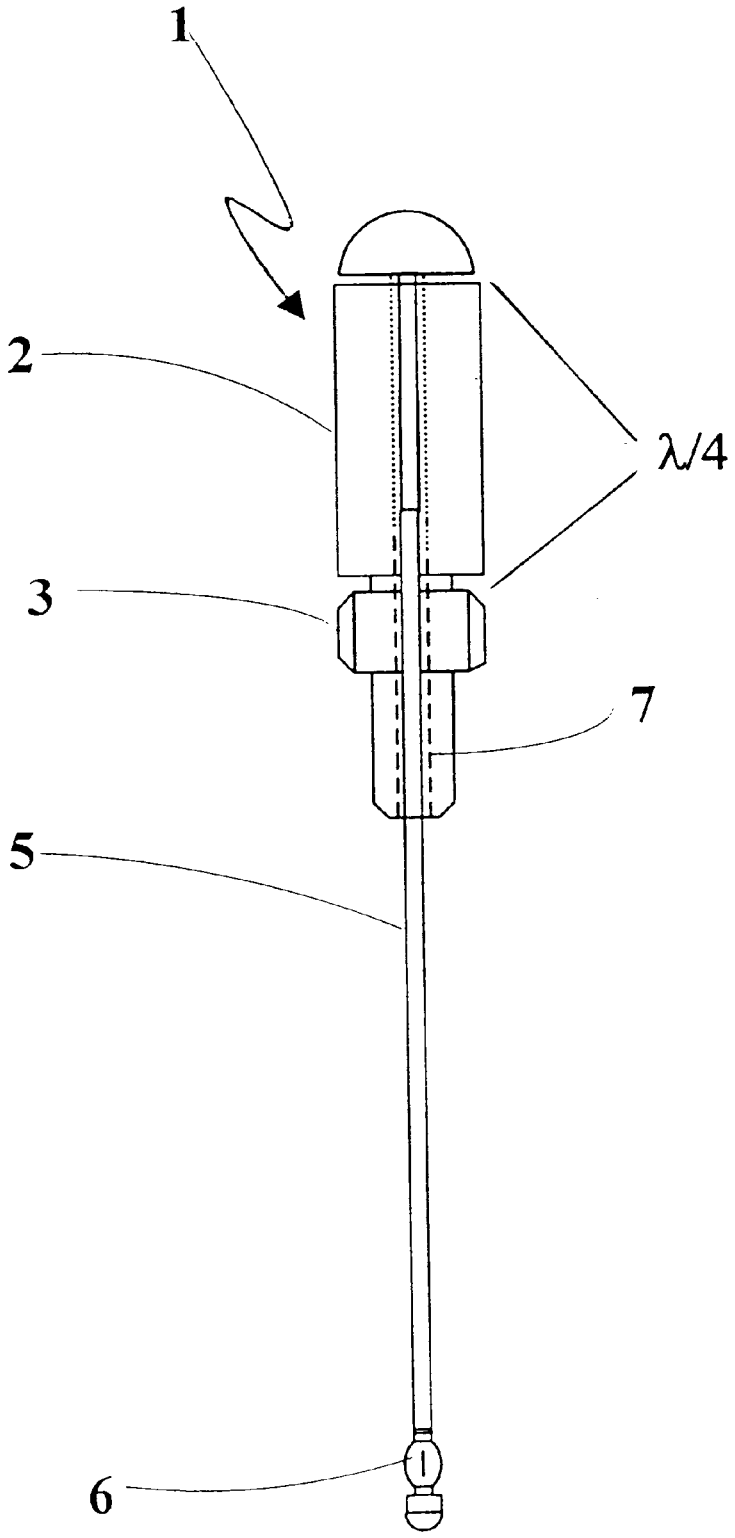
FIG. 3*a* is a second preferred embodiment of a combined antenna according to the present invention with the whip component retracted.
Figure 3B:
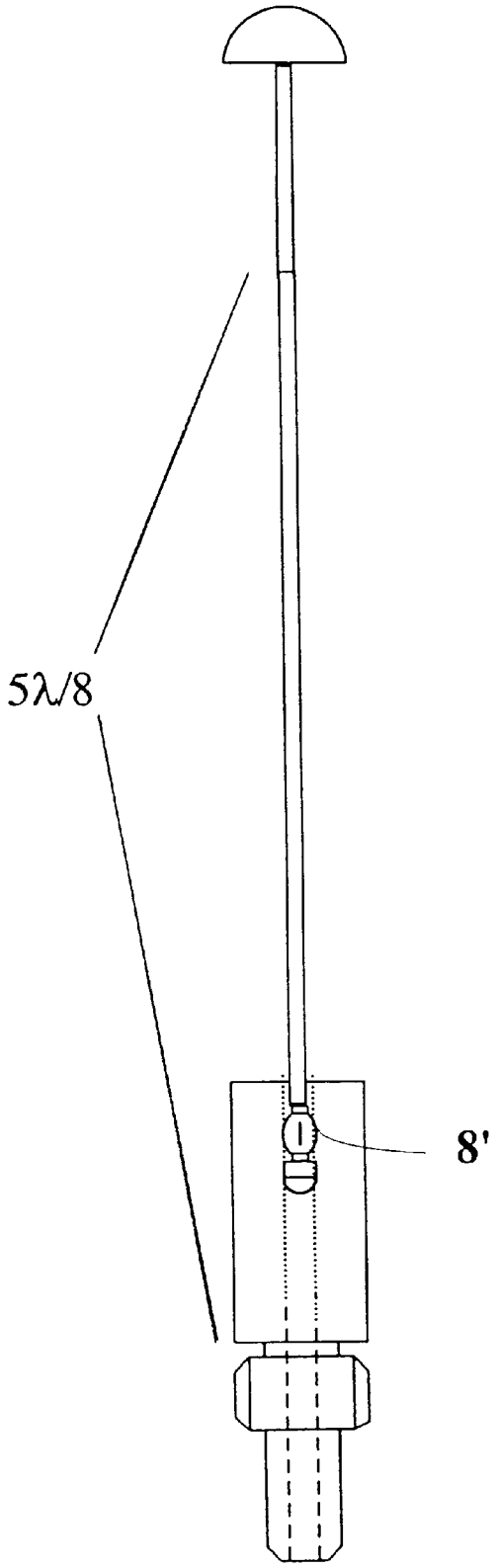
FIG. 3*b* is the combined antenna of FIG. 3*a* with the whip component pulled out.

FIGS. 3*a* and 3*b* show a certain second embodiment of a combined antenna. In departure from the embodiment in FIGS. 2*a* and 2*b*, the whip element 5, when pulled out, locks inside the monopole element 2 at locking point 8' in the upper part thereof with the aid of the lamellar sleeve 6. In the antenna in FIGS. 3*a* and 3*b*, the electrical length of the antenna is $\lambda/4$ when the whip is retracted and $5\lambda/8$ when the whip is extended. In the latter position the whip component and the fat monopole radiator thus form a series connection.

The locking point 8 or 8' is formed for example so that the aperture 7 consists of two portions of differing diameter. The lower portion is made larger in diameter, in which case both the whip component and the lamellar sleeve move through it smoothly. The aperture above the desired locking point for the whip component is smaller in diameter, so that the lamellar sleeve locks the whip component at the bottom of the aperture of smaller diameter. The present invention does not in any way restrict the structure of the lamellar sleeve 6, but this is presented here as an example of how to achieve, at the bottom of the whip component, mechanical locking at a desired point in aperture 7 and the establishment of electrical contact between the whip component and the rest of the antenna structure when the whip component is pulled out.

Figure 4:
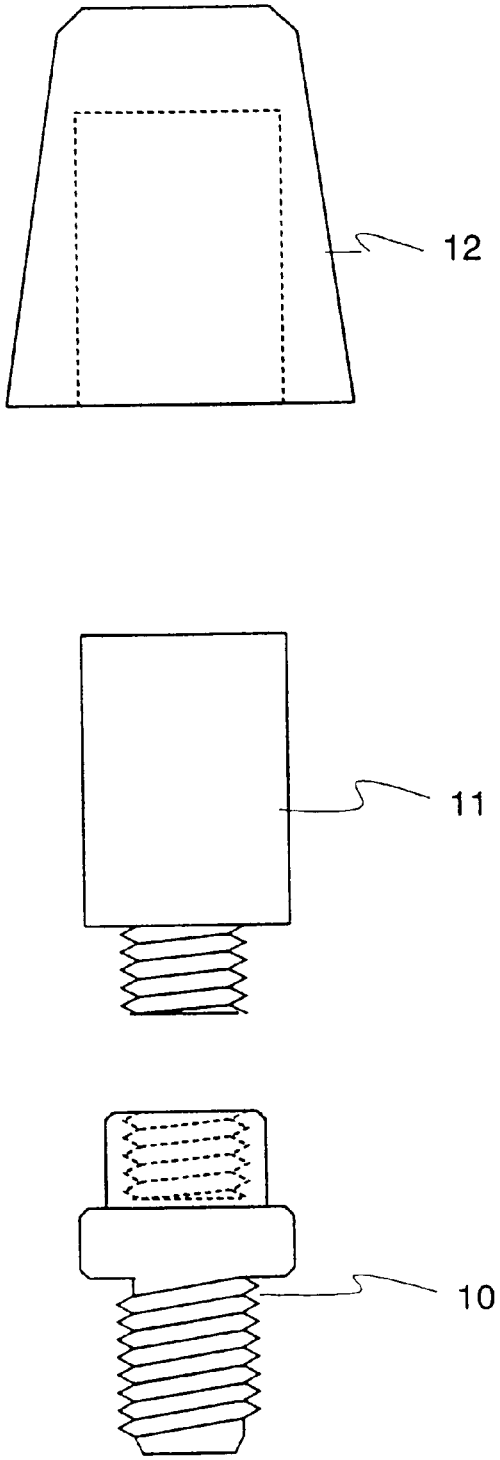
FIG. 4 is another preferred embodiment according to the present invention.

FIG. 4 shows an antenna structure in which the connector 10 and fat monopole 11 are different pieces which are joined together by screwing. This antenna structure is suitable, for example, for an antenna to be produced by an antenna manufacturer who has previously made helical antennas and who consequently has a large stock of connectors 10 with joint sockets. When a screw thread is formed in the cylindrical joint socket at the top of such a connector, it is easy to attach to it fat monopoles which have a corresponding thread at their bottom. Other methods of connection known to those skilled in the art are also possible. In the finished antenna, the monopole radiator and the connector form essentially an integrated structure, which does not deviate in its mechanical or electrical characteristics from the bodies manufactured from the start from a single piece, as described above. An insulating protective casing 12 goes over the fat monopole. It is further possible to make a combined antenna from the structure according to FIG. 4, by drilling an aperture through the structure in the direction of the axis of symmetry and placing a whip component therein.

The table below contains some examples of dimensions used for monopole- and whip antennas for PCN and PCS systems.

| System | Length of whip | Length of monopole (mm) | Diameter of monopole (mm) |
|---|---|---|---|
| PCN | $\lambda/4$ (54 mm) | 25 | 6.0 |
| PCN | $5\lambda/8$ (130 mm) | 25 | 6.0 |
| PCS | $\lambda/4$ (49 mm) | 20 | 6.0 |
| PCS | $\lambda 5/8$ (120 mm) | 20 | 6.0 |

Above are presented some embodiments of the antenna structure according to the invention, but it is clear that the invention is not limited to these solutions alone. For example, the length or locking mechanism of the whip element may consist of any solution generally known in the art.

I claim:

1. A radiofrequency antenna, comprising:

a connector mechanically and electrically connecting said antenna to a radio set;

a first antenna element including a fat monopole radiator; and a second antenna element movable relative to said fat monopole radiator, said first antenna element and said second antenna element both being fed through a common feed point in said connector.

2. A radiofrequency antenna according to claim 1, wherein said connector and said fat monopole radiator are the same piece.

3. A radiofrequency antenna according to claim 1, wherein said connector and said fat monopole radiator are different pieces joined rigidly to each other to constitute a substantially integrated structure.

4. A radiofrequency antenna according to claim 3, wherein said second antenna element is a whip component.

5. A radiofrequency antenna according to claim 4, wherein said substantially integrated structure formed by the connector and said fat monopole radiator has axially symmetry and has an aperture substantially parallel with the axis of symmetry from movement of said whip component in the direction of the axis of symmetry between two extreme positions and said whip component extends via said aperture through the connector and said fat monopole radiator.

6. A radiofrequency antenna according to claim 5, wherein said whip component has a tope and a bottom, there being a widening of said whip component at said bottom for locking to a predetermined locking point in said aperture and for forming an electrical contact between said bottom of said whip component and said locking point at the other extreme position of said whip component.

7. A radiofrequency antenna according to claim 6, wherein said locking point is in said substantially integrated structure formed by the connector and said fat monopole radiator at the end next to the connector.

8. A radiofrequency antenna according to claim 6, wherein said locking point is in said integral structure formed by the connector and said fat monopole radiator at the end next to said fat monopole radiator.

9. A radiofrequency antenna according to claim 6, wherein at said locking point the diameter of said aperture changes.

* * * * *